US006592296B2

(12) United States Patent
Gutschmidt et al.

(10) Patent No.: US 6,592,296 B2
(45) Date of Patent: Jul. 15, 2003

(54) SEALING ASSEMBLY FOR TUNNEL CONSTRUCTION SECTIONS

(75) Inventors: Holger Gutschmidt, Neu Wulmstorf (DE); Heiko Höft, Rosengarten (DE); Dieter Kassel, Ronnenberg (DE)

(73) Assignee: Phoenix, Hamburg (DE)

( * ) Notice: Subject to any disclaimer, the term of this patent is extended or adjusted under 35 U.S.C. 154(b) by 0 days.

(21) Appl. No.: 09/980,156

(22) PCT Filed: Mar. 12, 2001

(86) PCT No.: PCT/DE01/00934

§ 371 (c)(1),
(2), (4) Date: Nov. 28, 2001

(87) PCT Pub. No.: WO01/75270

PCT Pub. Date: Oct. 11, 2001

(65) Prior Publication Data

US 2002/0164211 A1 Nov. 7, 2002

(30) Foreign Application Priority Data

Mar. 30, 2000 (DE) ..... 100 15 521

(51) Int. Cl.[7] ..... E21D 11/00; F16J 15/00; F16J 15/50

(52) U.S. Cl. ..... 405/152; 405/135; 405/147; 277/628; 277/649; 277/648

(58) Field of Search ..... 405/135, 147, 405/152; 277/565, 612, 625, 626, 648, 628, 649, 615; 404/64, 65, 68, 69, 47, 49, 74; 52/393, 396.02, 396.06, 396.08

(56) References Cited

U.S. PATENT DOCUMENTS

| | | | | | |
|---|---|---|---|---|---|
| 2,373,443 | A | | 4/1945 | Armington | |
| 3,625,578 | A | * | 12/1971 | Loftis | 277/565 X |
| 3,850,000 | A | * | 11/1974 | McBean | 405/147 X |
| 4,199,158 | A | | 4/1980 | De Munck | |
| 4,824,289 | A | | 4/1989 | Glang et al. | |
| 4,900,607 | A | * | 2/1990 | Glang et al. | 405/152 |
| 4,946,309 | A | | 8/1990 | Glang | |
| 4,995,623 | A | * | 2/1991 | Wada et al. | 277/565 X |
| 5,044,823 | A | * | 9/1991 | Burgess | 405/152 |
| 5,172,919 | A | * | 12/1992 | Takasaki et al. | 277/644 |
| 5,390,939 | A | | 2/1995 | Terauchi et al. | |
| 5,439,319 | A | * | 8/1995 | Flanagan et al. | 405/152 |
| 5,888,023 | A | * | 3/1999 | Grabe et al. | 405/152 |
| 6,267,536 | B1 | * | 7/2001 | Adachi et al. | 405/152 |
| 6,434,904 | B1 | * | 8/2002 | Gutschmidt et al. | 52/393 |

FOREIGN PATENT DOCUMENTS

| | | | | |
|---|---|---|---|---|
| DE | 198 26 482 | | 1/1999 | |
| DE | 199 28 877 | | 1/2000 | |
| DE | 100 43 637 | | 3/2001 | |
| GB | 2076481 | * | 12/1981 | 277/560 |
| GB | 2 340 896 | | 3/2000 | |
| WO | 93 14297 | | 7/1993 | |

* cited by examiner

*Primary Examiner*—Jong-Suk Lee
(74) *Attorney, Agent, or Firm*—Collard & Roe, P.C.

(57) ABSTRACT

A sealing assembly comprising two abutting components and a sealing profile produced from an elastomeric material, which bridges the gap between the two components to form a seal. The components are configured in particular as sections which are assembled into a tubular tunnel thus forming transverse and longitudinal joints. There is also a sealing profile being located in turn in each recess, thus forming a cornered sealing framework. There is also a lubricant for the contact surfaces between each component and the sealing profile, in particular for the contact surfaces between two sealing profiles. The sealing assembly has at least one sealing profile that has at least two protrusions in the vicinity of the contact surfaces. The protrusions form a sealed chamber, in which the lubricant is contained.

7 Claims, 2 Drawing Sheets

SEALING ASSEMBLY FOR TUNNEL CONSTRUCTION SECTIONS

CROSS REFERENCE TO RELATED APPLICATIONS

Applicants claim priority under 35 U.S.C. §119 of German Application No. 100 15 521.9 filed Mar. 30, 2000. Applicants also claim priority under 35 U.S.C. §365 of PCT/DE01/00934 filed Mar. 12, 2001. The international application under PCT article 21(2) was not published in English.

DESCRIPTION

The invention relates to a sealing assembly comprising at least the following:

Two abutting components made in particular of concrete or steel-reinforced concrete, as well as a sealing profile produced from an elastomeric material, which bridges the gap between the two components in a sealing manner, whereby the components are configured in particular as tunnel segments which are assembled so as to form a tubular tunnel, thus forming transverse and longitudinal joints, whereby each segment is preferably provided on extending all around and covering all abutting sides of the segments, whereby a sealing profile is in turn located in each recess, forming a sealing framework with corners of the framework; and a lubricant for the contact surfaces between the respective component and the sealing profile in particular for the contact surfaces between two sealing profiles (DE-A-198 26 482; U.S. Pat. No. 4,946,309; WO-A-93/14297).

In connection with the construction of tunnels, which is specified as a special field of application in the present case, the contact surfaces of two abutting sealing profiles abut one another flatly in most cases. In order to improve the sliding property of the sealing profiles one on top of the other when the segments are installed, the contact surfaces are usually lubricated with a lubricant. Now, when the sealing profile is pushed in, it is compressed, whereby the lubricant is then capable of exiting from the contact surfaces sideways without any obstruction. The adhesive friction between the contact surfaces one on the other increases in this connection due to the growing force of compression and conditioned by the loss of lubricant.

Now, it is proposed in WO-A-93/14297 that the sealing profile be provided within the zone of the contact surfaces with an additional profile layer that is harder and lower in friction than the basic body of the profile. With reduction of the lubricant, or even with omission of the latter, if need be, the additional layer of the profile now assumes the actual sliding task. The drawback here is, however, that the elasticity of the sealing profile and thus the sealing capacity is influenced in a negative way.

SUMMARY

The invention relates to a sealing assembly comprising at least two abutting components and at least two sealing profiles. The at least two abutting components are assembled to form a tubular tunnel and are spaced apart by a gap. Each of the at least two abutting components have at least one recess. The at least two sealing profiles, are made from elastomeric material and disposed an the gap between the at least two abutting components (2,3) in a sealing manner. Each of the at least two sealing profiles have a contact surface for allowing each of said at least two sealing profiles to contact each other. One or more of these contact surfaces can have a protrusion. There is also a lubricant disposed between said sealing profile and between said contact surfaces of said sealing profiles.

Useful variations of the sealing assembly are cited in patent claims 2 to 7.

BRIEF DESCRIPTION OF THE DRAWINGS

The invention is now explained onhand of embodiments by reference to schematic drawings. In the drawings.

DETAILED DESCRIPTION

Figure 1:
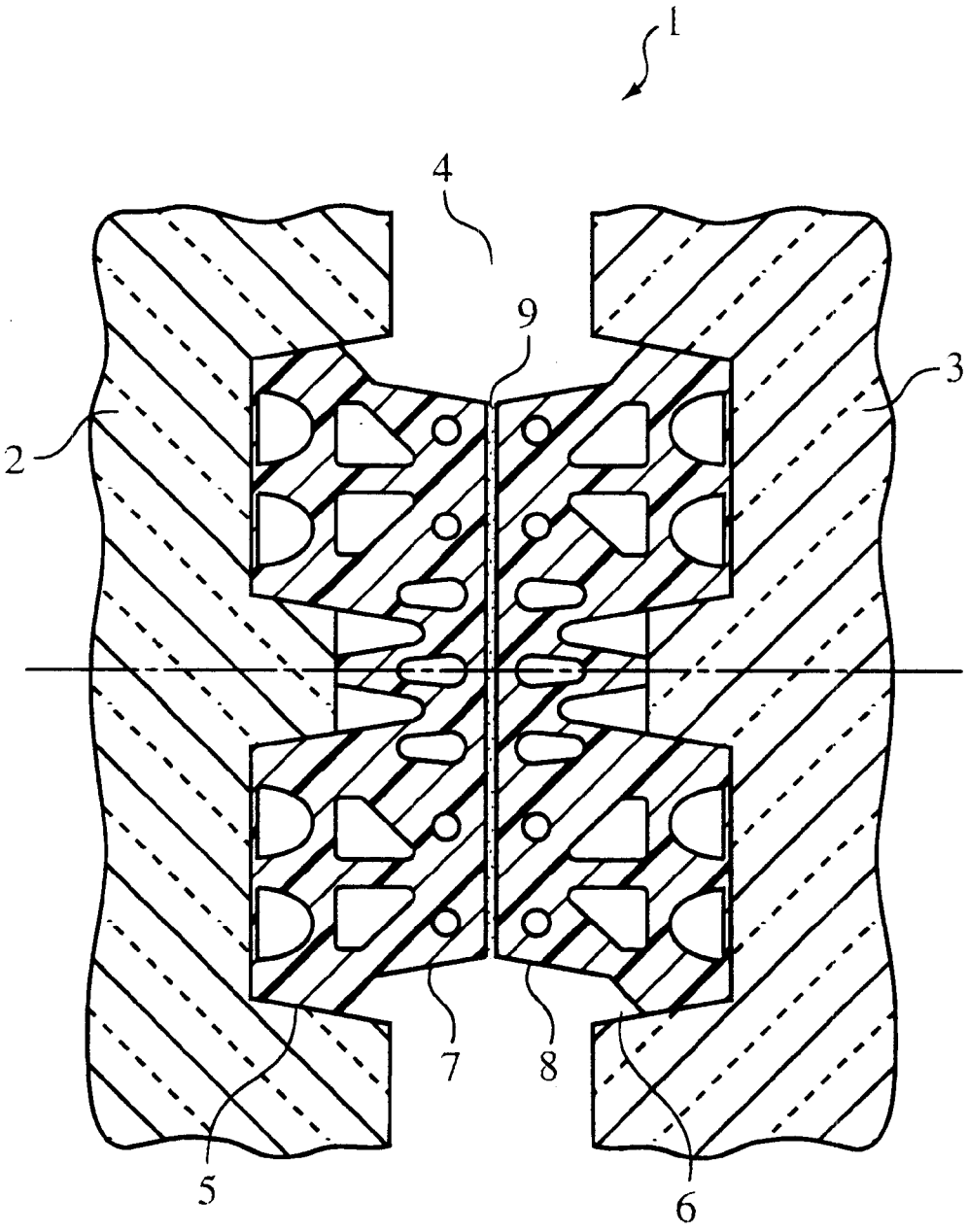
FIG. 1 shows a sealing assembly of the type specified above.

FIG. 1 shows within the framework of the tunnel construction a sealing assembly 1 comprising the two abutting segments 2 and 3 made of concrete, with formation of a gap 4. Each of said segments is provided with a recess 5 and 6, respectively, in which a strand-shaped sealing profile 7 and, respectively, 8 made of elastomeric material is seated. The sealing profile usually has fluted grooves and channels, whereby reference is made to laid-open patent specification DE-A-198 26 482 with respect to details in that regard.

Due to the compression of the abutting segments 2 and 3 with reduction of the spacing of the gap 4, the two sealing profiles 7 and 8 then develop their sealing capacity due to the interaction between force and reactive force.

Now, the lubricant is located within the zone of the contact surfaces 9 in order to improve the sliding movement of the sealing profiles one on top of the other.

Now, for the purpose of preventing the lubricant from exiting from the contact surfaces sideways as it is being compressed, it is proposed according to the invention that at least one of the two sealing profiles 7 and 8 is provided with at least two protrusions that form a sealing chamber in which the lubricant is contained.

The concept according to the invention is now explained by the example of a sealing profile that is described in greater detail in patent specification U.S. Pat. No. 4,946,309.

Figure 2:
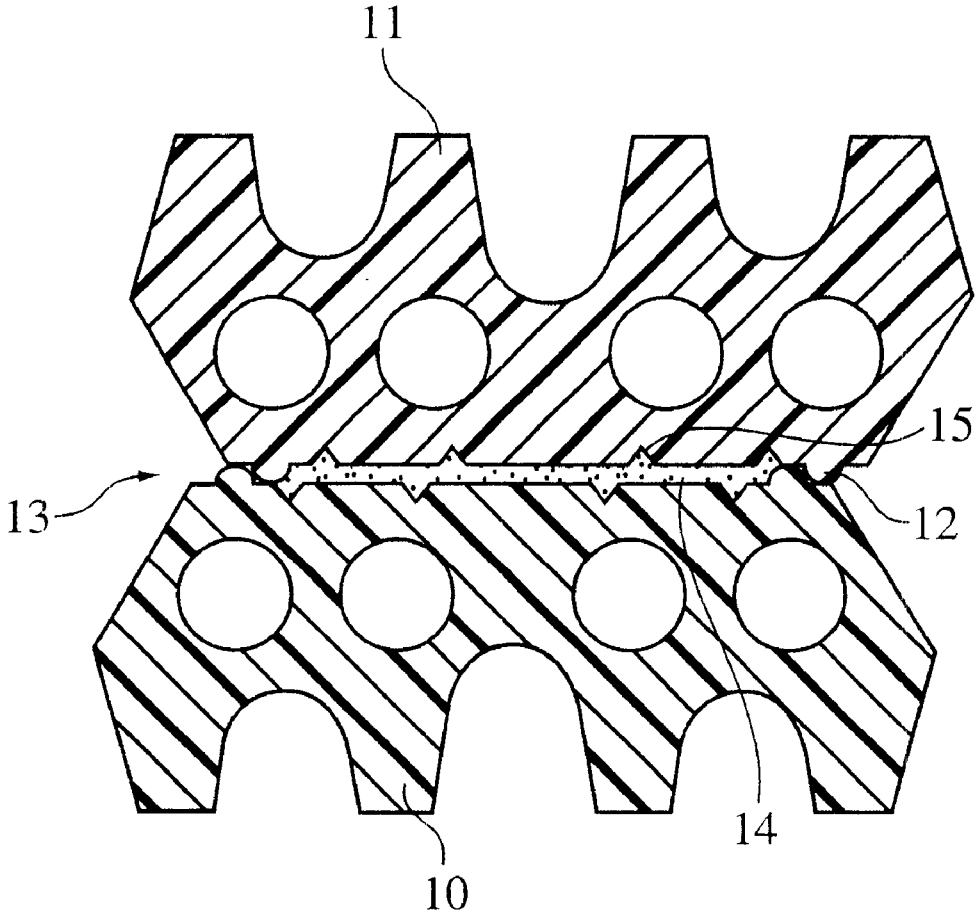
FIG. 2 shows two abutting sealing profiles with the chambered lubricant.

According to FIG. 2, each sealing profile 10 and 11 has the two protrusions 12 which, in the zone of the common contact surface 13, form a sealed chamber in which the lubricant 14 preferably in the form of a lubricating paste is contained. As shown in the present case, the lubricant is chambered also when the sealing profiles are displaced. During the act of compression, said protrusions form a barrier which makes it more difficult for the lubricant to exit sideways, or prevents it from exiting sideways. The two sealing profiles are sliding on a cushion of lubricant. This effect can be additionally reinforced by means of the notches 15, which are preferably present in both sealing profiles. The notches serve in the present connection as reservoirs for the lubricant 14.

It is particularly advantageous if the lubricant 14 is a swelling lubricant paste. In addition to the sliding function, such a swelling lubricant paste has an additional sealing function in that the paste swells as a result of any reaction with water or moisture.

Accordingly, while at least one embodiment of the present invention has been shown and described, it is to be understood that many changes and modifications may be made thereunto without departing from the spirit and scope of the invention as defined in fine appended claims.

List of Reference Numerals

1 Sealing assembly
2 Component (tunnel segment) made of concrete
3 Component (tunnel segment) made of concrete
4 Gap
5 Recess
6 Recess
7 Sealing profile made of elastomeric material
8 Sealing profile made of elastomeric material
9 Contact surfaces between the two sealing profiles
10 Sealing profile made of elastomeric material
11 Sealing profile made of elastomeric material
12 Protrusion
13 Contact surfaces between the two sealing profiles
14 Lubricant
15 Notch

What is claimed is:

1. A sealing assembly comprising:

a) at least two abutting components wherein said at least two abutting components are assembled to form a tubular tunnel and are spaced apart by a gap wherein each of said at least two abutting components have at least one recess;

b) at least two sealing profiles, made from elastomeric material and disposed in said gap between said at least two abutting components in a sealing manner, wherein each of said at least two sealing profiles have a contact surface for allowing each of said at least two sealing profiles to contact each other;

c) a lubricant disposed between said at least two sealing profiles and between said contact surfaces of said at least two sealing profiles; and d) at least two protrusions coupled to said contact surfaces of said at least two sealing profiles wherein said at least two protrusions form a sealed chamber in which said lubricant is contained.

2. The sealing assembly as in claim 1, wherein at least one of said at least two sealing profiles comprises at least one notch serving as a reservoir for lubricant.

3. The sealing assembly as in claim 2, wherein said at least one of said at least two sealing profiles comprises at least two notches.

4. The sealing assembly as in claim 1, wherein each of said at least two sealing profiles has at least one notch disposed in a zone of each of said contact surfaces for said at least two sealing profiles.

5. The sealing assembly as in claim 1, wherein each of said at least two sealing profiles comprises at least two protrusions disposed in a zone of said contact surface of said at least two sealing profiles.

6. The sealing assembly as in claim 1, wherein said lubricant is a lubricating paste.

7. The sealing assembly as in claim 1, wherein said lubricant is a swelling lubricating paste.

* * * * *